US006984276B2

(12) United States Patent
Zafiroglu et al.

(10) Patent No.: US 6,984,276 B2
(45) Date of Patent: Jan. 10, 2006

(54) METHOD FOR PREPARING HIGH BULK COMPOSITE SHEETS

(75) Inventors: Dimitri P. Zafiroglu, Wilmington, DE (US); Geoffrey David Hietpas, Newark, DE (US)

(73) Assignee: Invista North America S.arl., Wilmington, DE (US)

( * ) Notice: Subject to any disclaimer, the term of this patent is extended or adjusted under 35 U.S.C. 154(b) by 424 days.

(21) Appl. No.: 10/320,142

(22) Filed: Dec. 16, 2002

(65) Prior Publication Data

US 2003/0124939 A1 Jul. 3, 2003

Related U.S. Application Data

(60) Provisional application No. 60/343,322, filed on Dec. 21, 2001.

(51) Int. Cl.
*D04H 1/50* (2006.01)
*D04H 1/60* (2006.01)
*D04H 5/00* (2006.01)

(52) U.S. Cl. ..... 156/84; 156/148; 156/181; 156/283; 156/380.2; 264/109; 264/122; 264/128; 264/168; 264/172.14; 264/172.15; 264/175

(58) Field of Classification Search ..... 156/84, 156/148, 180–181, 283, 380.2; 264/109, 264/122, 128, 168, 172.14, 172.15, 175
See application file for complete search history.

(56) References Cited

U.S. PATENT DOCUMENTS

| | | | |
|---|---|---|---|
| 3,423,266 | A | 1/1969 | Davies et al. |
| 3,595,731 | A | 7/1971 | Davies et al. |
| 3,671,379 | A | 6/1972 | Evans et al. |
| 4,068,036 | A | 1/1978 | Stanistreet |
| 4,551,378 | A | 11/1985 | Carey, Jr. |
| 4,999,232 | A | 3/1991 | LeVan |
| 5,102,724 | A | 4/1992 | Okawahara et al. |
| 5,302,443 | A | 4/1994 | Manning et al. |
| 5,382,400 | A | 1/1995 | Pike et al. |
| 5,418,045 | A | 5/1995 | Pike et al. |
| 5,618,364 | A | 4/1997 | Kwok |

FOREIGN PATENT DOCUMENTS

| | | | |
|---|---|---|---|
| EP | 0 447 022 | A1 | 9/1991 |
| EP | 0 391 260 | B1 | 6/1994 |
| JP | HEI 8(1996)-19611 | A | 2/1996 |
| WO | WO 00/66821 | A1 | 11/2000 |
| WO | WO 02/31250 | A2 | 4/2002 |

*Primary Examiner*—Sam Chuan Yao
(74) *Attorney, Agent, or Firm*—Robert B. Furr, Jr.; Anne I. Breikss

(57) ABSTRACT

This invention relates to a method for preparing nonwoven fabrics having an improved balance of properties in the machine and cross-directions. More specifically, the invention utilizes nonwoven webs that include relatively low levels of multiple-component fibers having latent three-dimensional spiral crimp combined with fibers that do not develop spiral crimp. The latent spiral crimp of the multiple-component fibers is activated, such as by heating, under free shrinkage conditions, after formation of the nonwoven web to achieve re-orientation of the non-spirally-crimpable fibers and an improved balance of properties such as tensile strength and modulus.

26 Claims, 2 Drawing Sheets

METHOD FOR PREPARING HIGH BULK COMPOSITE SHEETS

BACKGROUND OF THE INVENTION

1. Field of the Invention

This invention relates to a method for preparing nonwoven fabrics containing low levels of multiple-component fibers which have latent three-dimensional spiral crimp, mixed with fibers which do not develop spiral crimp wherein the fabric has an improved balance of properties in the machine and cross-directions.

2. Description of Related Art

Nonwoven fabrics comprising laterally eccentric multiple-component fibers comprising two or more synthetic components that differ in their ability to shrink are known in the art. Such fibers develop three-dimensional helical (spiral) crimp when the crimp is activated by subjecting the fibers to shrinking conditions in an essentially tensionless state. Helical crimp is distinguished from the two-dimensional crimp of mechanically crimped fibers such as stuffer-box crimped fibers. Helically crimped fibers generally stretch and recover in a spring-like fashion.

U.S. Pat. No. 3,595,731 to Davies et al. (Davies) describes bicomponent fibrous materials containing crimped fibers which are bonded mechanically by the interlocking of the spirals in the crimped fibers and adhesively by melting of a low-melting adhesive polymer component. The crimp can be developed and the potentially adhesive component activated in one and the same treatment step, or the crimp can be developed first followed by activation of the adhesive component to bond together fibers of the web which are in a contiguous relationship. The crimp is developed under conditions where no appreciable pressure is applied during the process that would prevent the fibers from crimping.

U.S. Pat. No. 5,102,724 to Okawahara et al (Okawahara) describes the finishing of nonwoven fabrics comprising bicomponent polyester filaments produced by conjugate spinning of side-by-side filaments of polyethylene terephthalate copolymerized with a structural unit having a metal sulfonate group and a polyethylene terephthalate or a polybutylene terephthalate. The filaments are mechanically crimped prior to forming a nonwoven fabric. The fabric is rendered stretchable by exposure to infrared radiation while the filaments are in a relaxed state. During the infrared heating step, the conjugate filaments develop three-dimensional crimp. One of the limitations of this process is that it requires a separate mechanical crimping process in addition to the crimp developed in the heat treatment step. In addition, the process of Okawahara requires the web or fabric to be in continuous contact with a conveyor such as a bar conveyor or a pre-gathering slot along spaced lines corresponding to the bars in the bar conveyor or lines of contact where the web contacts the gathering slot, as the product is shrunk or prepared for shrinking. Processing through a pre-gathering slot requires the use of cohesive fabrics that are pre-integrated and cannot be used with the substantially non-bonded nonwoven webs that are used in the process of the current invention. Multiple-line contact with a bar conveyor during the shrinkage step interferes with fabric shrinkage, crimp development, and fiber re-orientation even when the fabric is overfed onto the conveyor.

PCT Published Application No. WO 00/66821 describes stretchable nonwoven webs that comprise a plurality of bicomponent filaments that have been point-bonded prior to heating to develop crimp in the filaments. The bicomponent filaments comprise a polyester component and another polymeric component that is preferably a polyolefin or polyamide. The heating step causes the bonded web to shrink resulting in a nonwoven fabric which exhibits elastic recovery in both the machine direction and the cross direction when stretched up to 30%. Since the length of fiber segments between the bond points varies, pre-bonding of the fabric prior to shrinkage does not allow unimpeded crimp development among all of the filaments since the shrinking stresses are unequally distributed among the filaments. As a result, overall shrinkage, shrinkage uniformity, crimp development, and crimp uniformity are reduced.

Japanese Kokoku Patent Number 8(1996)-19661, assigned to Japan Vilene Co., Ltd., describes nonwoven fabrics containing at least 30 percent of side-by-side latent crimpable fibers which have been hydraulically entangled followed by heat treatment to develop the crimp of the latent crimpable fibers. The hydraulic entanglement of the fibers prior to shrinkage does not allow equal and unimpeded crimp development.

U.S. Pat. No. 3,671,379 to Evans et al. (Evans) describes self-crimpable composite filaments which comprise a laterally eccentric assembly of at least two synthetic polyesters, the first of said two polyesters being partly crystalline in which the chemical repeat-units of its crystalline region are in a non-extended stable conformation and the second of said two polyesters being partly crystalline in which the chemical repeat-units of the crystalline region are in a conformation more closely approaching the length of the conformation of its fully extended chemical repeat-units. The composite filaments are capable of developing a high degree of spiral crimp against the restraint imposed by high thread count woven structures, which crimp potential is unusually well retained despite application of elongating stress and high temperature. The composite filaments increase, rather than decrease, in crimp potential when annealed as a part of the fiber production process. The filaments are described as being useful in knitted, woven, and nonwoven fabrics. Preparation of continuous filament and spun staple yarns and their use in knitted and woven fabrics is demonstrated.

Carded staple webs, including those containing multiple-component fibers, are well known in the art. Fibers in carded webs are characterized by machine direction ("MD") and cross-direction ("XD") web axes. Carded webs have a predominance of MD-oriented fibers that yield fabrics having correspondingly enhanced MD and diminished CD tensile strength. Air-laid and spunbonded webs also, in general, tend to favor MD orientation to various degrees depending upon the type of machinery, fiber, and laydown conditions. Cross-lapped carded webs with many layers tend to have a fiber orientation predominantly in the cross direction. There exists a need for providing uniform nonwovens from carded webs and other nonwoven processes that have an improved balance of properties in the machine and cross direction, especially to provide balanced tensile strength as well as uniformity and drape.

BRIEF SUMMARY OF THE INVENTION

This invention is directed to a method for modifying the ratio of machine-direction and cross-direction orientation in nonwoven webs which comprises the steps of:

providing a substantially non-bonded nonwoven web having an initial direction of highest fiber orientation, the web comprising about 5 to 40 weight percent of a first fiber component and about 95 to 60 weight percent of a second fiber component, the first fiber component consisting essentially of multiple-component fibers capable of developing three-dimensional spiral crimp upon heating and the second fiber component consisting essentially of fibers which do not develop spiral crimp upon heating; and heating the substantially non-bonded nonwoven web under free shrinkage conditions to a temperature sufficient to cause the multiple-component fibers to develop three-dimensional spiral crimp, the heating temperature being selected such that the heat-treated nonwoven web remains substantially non-bonded during the heating step and to cause the substantially non-bonded nonwoven web to shrink by at least about 10% in the initial direction of highest original web orientation.

This invention is also directed to a nonwoven web having a machine-direction, a cross-direction and an initial direction of highest fiber orientation selected from one of the machine direction orientation and the cross direction orientation, comprising about 5 to 40 weight percent of a first fiber component and about 95 to 60 weight percent of a second fiber component, the first fiber component consisting essentially of multiple-component fibers capable of developing three-dimensional spiral crimp upon heating and the second fiber component consisting essentially of fibers which do not develop spiral crimp upon heating and wherein the ratio of direction of highest fiber orientation and direction of lowest fiber orientation after heating the web is at least 30% less than the ratio of direction of highest fiber orientation and direction of lowest fiber orientation of a web consisting of 100% of the non-spirally-crimpable fibers as measured by the ratio of direction of highest fiber orientation tensile strength to the direction of lowest fiber orientation tensile strength.

DETAILED DESCRIPTION OF THE INVENTION

Figure 1:
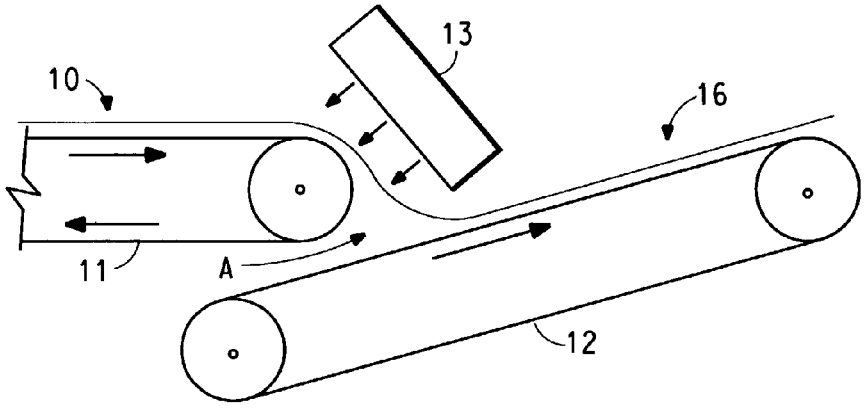
FIG. 1 is a schematic diagram of a side view of an apparatus suitable for carrying out the crimp-activation step in a first embodiment of the process of the current invention in which a web comprising a blend of spirally-crimpable and non-spirally-crimpable fibers is allowed to free fall from a first conveyor onto a second conveyor.

The term "polyester" as used herein is intended to embrace polymers wherein at least 85% of the recurring units are condensation products of dicarboxylic acids and dihydroxy alcohols with linkages created by formation of ester units. This includes aromatic, aliphatic, saturated, and unsaturated di-acids and di-alcohols. The term "polyester" as used herein also includes copolymers (such as block, graft, random and alternating copolymers), blends, and modifications thereof. Examples of polyesters include poly (ethylene terephthalate) (PET) which is a condensation product of ethylene glycol and terephthalic acid, and poly (trimethylene terephthalate) (PTT) which is a condensation product of 1,3-propanediol and terephthalic acid.

The term "nonwoven" fabric, sheet, or web as used herein means a textile structure of individual fibers, filaments, or threads that are directionally or randomly oriented and bonded by friction, and/or cohesion and/or adhesion, as opposed to a regular pattern of mechanically inter-engaged fibers, i.e. it is not a woven or knitted fabric. Examples of nonwoven fabrics and webs include spunbond continuous filament webs, carded webs, air-laid webs, and wet-laid webs. Suitable bonding methods include thermal bonding, chemical or solvent bonding, resin bonding, mechanical needling, hydraulic needling, stitchbonding, etc.

The terms "multiple-component filament" and "multiple-component fiber" as used herein refer to any filament or fiber that is composed of at least two distinct polymers which have been spun together to form a single filament or fiber. The process of the current invention may be conducted using either short (staple) fibers or continuous filaments in the nonwoven web. As used herein, the term "filament" is used to describe continuous filaments whereas the term "fiber" includes both continuous filaments and discontinuous (staple) fibers. By the term "distinct polymers", it is meant that each of the at least two polymeric components are arranged in distinct substantially constantly positioned zones across the cross-section of the multiple-component fibers and extend substantially continuously along the length of the fibers. Multiple-component fibers are distinguished from fibers that are extruded from a homogeneous melt blend of polymeric materials in which zones of distinct polymers are not formed. The at least two distinct polymeric components useable herein can be chemically different or they can be chemically the same polymer, but having different physical characteristics, such as tacticity, intrinsic viscosity, melt viscosity, die swell, density, crystallinity, and melting point or softening point. One or more of the polymeric components in the multiple-component fiber can be a blend of different polymers. Multiple-component fibers useful in the current invention have a laterally eccentric cross-section, that is, the polymeric components are arranged in an eccentric relationship in the cross-section of the fiber so as to be capable of developing three-dimensional spiral crimp. Preferably, the multiple-component fibers are bicomponent fibers which are made of two distinct polymers and having an eccentric sheath-core or a side-by-side arrangement of the polymers. Most preferably, the multiple-component fibers are side-by-side bicomponent fibers. If the bicomponent fibers have an eccentric sheath-core configuration, the lower melting polymer is preferably in the sheath to facilitate thermal point bonding of the nonwoven fabric after it has been heat treated to develop three-dimensional spiral crimp.

The term "spunbond" filaments as used herein means filaments which are formed by extruding molten thermoplastic polymer material as continuous strands from a plurality of fine, usually circular, capillaries of a spinneret with the diameter of the extruded filaments then being rapidly reduced by drawing. Other fiber cross-sectional shapes such as oval, multi-lobal, etc. can also be used. Spunbond filaments are generally continuous and have an average diameter of greater than about 5 micrometers. Spunbond webs are formed by laying spun filaments randomly on a collecting surface such as a foraminous screen or belt using methods known in the art. Spunbond webs are generally bonded by methods known in the art such as by thermally point bonding the web at a plurality of discrete thermal bond points, lines, etc. located across the surface of the spunbond fabric.

The term "substantially non-bonded nonwoven web" is used herein to describe a nonwoven web in which there is little or no inter-fiber bonding. That is, the fibers in the web can be removed individually from the web due to the substantial lack of bonding or entanglement. It is important in the process of the current invention that the fibers in the nonwoven web are not bonded to any significant degree prior to and during activation of the three-dimensional spiral crimp so that crimp development is not hindered by restrictions imposed by bonding. In some instances, it may be desirable to pre-consolidate the web at low levels prior to heat treatment in order to improve the cohesiveness or handleability of the web. However, the degree of pre-consolidation should be low enough that the percent area shrinkage of the pre-consolidated nonwoven web during the heat treatment step of the process of the current invention is at least 90%, preferably at least 95%, of the area shrinkage of an identical nonwoven web that has not been pre-consolidated prior to crimp development and which is subjected to heat treatment under identical conditions. Pre-consolidation of the web can be achieved using very light mechanical needling or by passing the unheated fabric through an unheated nip, preferably a nip of two intermeshing rolls. The nonwoven web should remain substantially non-bonded while undergoing heat treatment to activate the latent spiral crimp of the multiple-component fibers. The temperature of the web during crimp activation of the multiple-component fibers should not be so high as to cause bonding between the fibers in the web. The temperature during crimp activation is preferably maintained at least 20° C. lower than the melting point of the lowest-melting component in the multiple-component fibers or of any binder fibers, binder powder, etc. that have been added to the web. Since most spirally-crimpable fibers are induced or activated to form the spiral crimp configuration between 40° C. and 100° C., the binder components in the web preferably have a melting point of at least about 120° C.

The term "machine direction" (MD) is used herein to refer to the direction in which the substantially non-bonded nonwoven web is produced. The term "cross direction" (XD) refers to the direction generally perpendicular to the machine direction. The ratio of fiber orientation in the MD to fiber orientation in the XD is calculated by dividing the tensile strength in the MD by the tensile strength in the XD for a bonded web. For webs containing fibers possessing latent spiral crimp, the initial orientation ratio is calculated by measuring the ratio of MD to XD tensile strength of a bonded web formed without activation of the latent spiral crimp. The improvement in the balance of MD and XD orientation can be determined by comparing the ratio of MD to XD strength of a web formed by bonding a web comprising a blend of spirally-crimpable fibers and non-spirally-crimpable fibers that has been heat-treated according the method of the current invention to the ratio of MD to XD strength of a comparably bonded web having substantially the same basis weight and consisting of 100% of the same non-spirally-crimpable fibers which has been heat treated under substantially identical conditions.

The present invention is directed toward a method for improving the balance of machine direction and cross direction properties in nonwoven webs by incorporating about 5 to 40 weight percent of laterally eccentric multiple-component fibers or filaments having latent three-dimensional spiral crimp into a non-bonded web of fibers or filaments which do not have latent spiral crimp. The web of blended fibers is heated to activate the spiral crimp under "free shrinkage" conditions which allows the fibers to crimp substantially equally and uniformly to develop their full crimp potential without being hindered by inter-fiber bonds, mechanical friction between the web and other surfaces, or other effects that might hinder crimp formation in the multiple-component fibers.

Figure 4A:
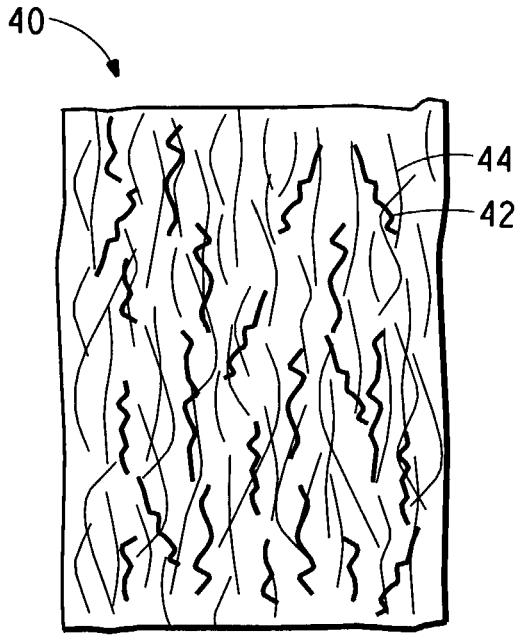
FIG. 4*a* is a schematic diagram of a top view of a staple web comprising a blend of spirally-crimpable and non-spirally-crimpable fibers prior to the activation of the spirally-crimpable fibers.
Figure 4B:
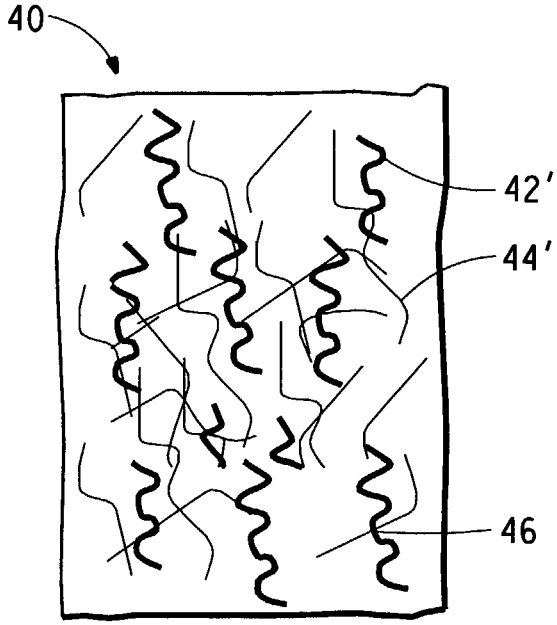
FIG. 4*b* is a schematic diagram of a top view of the web of FIG. 4*a* after the spirally-crimpable fibers have been activated.

As the multiple-component fibers develop spiral crimp in the heating step, they shrink towards the direction of the fiber axis and the non-spirally crimped fibers, which are engaged by the multiple-component fibers, are caused to re-orient towards the direction perpendicular to the shrinkage of the multiple-component fibers. This is shown schematically in FIGS. 4*a* and 4*b*. Nonwoven web 40 comprises multiple-component fibers 42 having latent spiral crimp, shown as having an initial low level of spiral crimp in FIG. 4*a*, and non-spirally-crimpable fibers 44. The fibers of web 40 are oriented primarily in the machine direction. When spirally-crimpable fibers 42 are activated, such as by heating, they develop spiral crimp as shown in FIG. 4*b*. The spirally crimped fibers 42' engage non-spirally-crimpable fibers 44 at one or more points 46 along their lengths, and they effectively compress the web along their entire length, forcing the reorientation of the web fibers in the direction perpendicular to the compression, in much the same manner in which decelerating doff rollers compress and re-orient the fibers of a carded web. When the fibers are predominantly oriented in the machine direction of the web as shown in FIG. 4*a*, such as in a carded web, the non-spirally crimped fibers are re-oriented during activation of the latent spiral crimp of the multiple-component fibers and shift the balance of orientation somewhat to the cross-direction so that the ratio of machine direction to cross direction tensile strength more closely approaches a value of one. As seen in FIG. 4*b*, the non-spirally-crimpable fibers 44 are oriented to a lesser degree in the machine direction in the web after crimp activation than they were prior to crimp activation. In webs containing spirally-crimpable multiple-component fibers at levels greater than about 25%, some increase in the stretchability of the nonwoven fabric may also be achieved. However, this is not required and the main function of the multiple-component fibers or filaments in the method of the current invention is to re-orient the other fibers or filaments in the web.

Laterally eccentric multiple-component fibers comprising two or more synthetic components that differ in their ability to shrink are known in the art. Such fibers form spiral crimp when the crimp is activated by subjecting the fibers to shrinking conditions in an essentially tensionless state. The amount of crimp is directly related to the difference in shrinkage between the polymeric components in the fibers. When the multiple-component fibers are spun in a side-by-side configuration, the crimped fibers that are formed after crimp activation have the higher-shrinkage component on the inside of the spiral helix and the lower-shrinkage component on the outside of the helix. Such crimp is referred to herein as spiral crimp. Such crimp is distinguished from mechanically crimped fibers such as stuffer-box crimped fibers which generally have two-dimensional crimp.

A variety of thermoplastic polymers may be used as the components of the spirally-crimpable multiple-component fibers. Examples of combinations of thermoplastic resins suitable for forming spirally-crimpable, multiple-component fibers are crystalline polypropylene/high density polyethylene, crystalline polypropylene/ethylene-vinyl acetate copolymers, polyethylene terephthalate/high density polyethylene, poly(ethylene terephthalate)/poly(trimethylene terephthalate), poly(ethylene terephthalate)/poly(butylene terephthalate), and nylon 66/nylon 6.

To achieve high levels of three-dimensional spiral crimp and shrinking power, the polymeric components of the multiple-component fibers are preferably selected according to the teaching in Evans, which is hereby incorporated by reference. The Evans patent describes bicomponent fibers in which the polymeric components are partly crystalline polyesters, the first of which has chemical repeat-units in its crystalline region that are in a non-extended stable conformation that does not exceed 90 percent of the length of the conformation of its fully extended chemical repeat units, and the second of which has chemical repeat-units in its crystalline region which are in a conformation more closely approaching the length of the conformation of its fully extended chemical repeat-units than the first polyester. The term "partly crystalline" as used in defining the filaments of Evans serves to eliminate from the scope of the invention the limiting situation of complete crystallinity where the potential for shrinkage would disappear. The amount of crystallinity, defined by the term "partly crystalline" has a minimum level of only the presence of some crystallinity (i.e. that which is first detectable by X-ray diffraction means) and a maximum level of any amount short of complete crystallinity. Examples of suitable fully extended polyesters are poly(ethylene terephthalate), poly (cyclohexyl 1,4-dimethylene terephthalate), copolymers thereof, and copolymers of ethylene terephthalate and the sodium salt of ethylene sulfoisophthalate. Examples of suitable non-extended polyesters are poly(trimethylene terephthalate), poly(tetramethylene terephthalate), poly(trimethylene dinaphthalate), poly (trimethylene bibenzoate), and copolymers of the above with ethylene sodium sulfoisophthalate, and selected polyester ethers. When ethylene sodium sulfoisophthalate copolymers are used, it is preferably the minor component, i.e. present in amounts of less than 5 mole percent and preferably present in amounts of about 2 mole percent. In an especially preferred embodiment, the two polyesters are poly(ethylene terephthalate) and poly(trimethylene terephthalate). The bicomponent filaments of Evans have a high degree of spiral crimp, generally acting as springs, having a recoil action whenever a stretching force is applied and released. Other partly crystalline polymers which are suitable for use in the current invention include syndiotactic polypropylene which crystallizes in an extended conformation and isotactic polypropylene which crystallizes in a non-extended, spiral conformation.

In a preferred embodiment, at least a portion of the surface of the multiple-component fibers forming the nonwoven web are made from a polymer that is heat bondable. By heat bondable, it is meant that when the multiple-component fibers forming the nonwoven web are subjected to heat and/or ultrasonic energy of a sufficient degree, the fibers will adhere to one another at the bonding points where heat is applied due to the melting or partial softening of the heat-bondable polymer. The polymeric components are preferably chosen such that the heat bondable component has a melting temperature that is at least about 20° C. less than the melting point of the other polymeric components. Suitable polymers for forming such heat bondable fibers are permanently fusible and are typically referred to as being thermoplastic. Examples of suitable thermoplastic polymers include, but are not limited to polyolefins, polyesters, polyamides, and can be homopolymers or copolymers, and blends thereof. When the multiple-component fibers are eccentric sheath-core fibers, the lower melting or softening polymer preferably forms the sheath of the fiber when thermal bonding methods are used to form a bonded nonwoven fabric.

The reoriented webs of this invention may be bonded by any method including resin bonding, continuous thermal bonding, discrete thermal bonding or chemical bonding. They can also be bonded by hydraulic-needling (i.e., spunlacing) or mechanical needling (needle-punching), with the same improvement in the final balance of mechanical properties. In fact, entangled webs with a balanced fiber orientation tend to have much better disentanglement resistance, as well as balanced strength compared to webs with a predominantly machine-direction orientation which have not been re-oriented according to the process of the current invention. Substantially non-bonded fibrous webs useful in the current invention can be prepared from blends of multiple-component fibers having latent spiral crimp with fibers that do not form spiral crimp using methods known in the art. Any combination of staple or continuous filaments can be used.

Substantially non-bonded staple fiber webs containing blends of multiple-component fibers having latent three-dimensional spiral crimp with fibers that do not develop spiral crimp may be prepared using known methods, such as, carding or air-laying. Staple fibers which do not possess latent spiral crimp and therefore are suitable for use in blends with the spirally-crimpable multiple-component fibers include natural fibers such as cotton, wool, and silk and synthetic fibers including polyamide, polyester, polyacrylonitrile, polyethylene, polypropylene, polyvinyl alcohol, polyvinyl chloride, polyvinylidene chloride, and polyurethane. The non-spirally-crimpable staple fibers can have the same length as the multiple-component fibers having latent spiral crimp. Preferably, the fibers having latent spiral crimp are longer than the non-spirally-crimpable fibers. Longer spirally-crimpable multiple-component fibers are more efficient than shorter fibers because they engage a larger number of the web fibers simultaneously as they shrink and pull the non-spirally-crimpable fibers. In a preferred embodiment, the spirally-crimpable multiple-component fibers have a length of 2 to 3 inches (5 to 7.6 cm) and the non-spirally-crimpable staple fibers have a length of 0.5 to 1.5 inches (1.3 to 3.8 cm).

The different staple fibers should be substantially uniformly intermixed in the web so that the multiple-component fibers having latent spiral crimp contact a sufficient number of non-spirally-crimpable fibers to re-orient them during the crimp-activation step and to achieve the desired degree of re-orientation and improvement in balance of properties. The staple fiber blends can be prepared prior to web formation or the fibers can be blended in the web-forming step itself. The staple web preferably contains about 5 to 40 weight percent, more preferably about 10 to 25 weight percent, and most preferably about 10 to 15 weight percent multiple-component fibers that are capable of developing three-dimensional spiral crimp.

In a preferred embodiment of the invention, the staple web is a carded web prepared using a carding or garnetting machine. The polymeric components used to form the multiple-component staple fibers are preferably selected such that there is sufficient interbonding between the distinct polymeric components so that there is substantially no separation of the components in the carding process. The staple fibers in carded webs are oriented predominantly in the machine direction and the ratio of MD to XD orientation in typical carded webs which have not been re-oriented according to the process of the invention is generally between about 4:1 and 10:1. The multiple-component staple fibers used to form the carded web preferably have a denier per filament between about 0.5 and 6.0, a fiber length between about 0.5 inch (1.27 cm) and 4 inches (10.1cm) and crimp properties of Crimp Index (CI)=8–15% and Crimp Development (CD)=40–60%. The aforementioned range for CI is desirable. For carding, the staple fibers preferably have a CI no greater than 45%. The relationship of CI to CD is provided below. These crimp properties are defined in the test method preceding the Examples below. Preferably, the initial crimp in the multiple-component fibers is formed by partially developing the latent spiral crimp of the fibers during the fiber manufacturing process. This is achieved by allowing the fibers to relax by adjusting tension and temperature during the fiber spinning and drawing processes. Alternately, the multiple-component fibers can be mechanically crimped prior to carding to increase processability.

The web obtained from a single card or garnet may be superimposed on a plurality of such webs to build up a web having sufficient thickness and uniformity for the intended end use. The plurality of layers may also be laid down such that alternate layers of carded webs are disposed with their fiber orientation directions disposed at a certain angle to form a cross-lapped web. For example, the layers may be disposed at 90 degrees with respect to intervening layers. In cross-lapped heavy webs comprising a large number of layers, the orientation can shift from a MD-oriented web for a single layer to a cross-lapped web in which the fibers are overall more highly oriented in the cross direction. In that case, the process of the current invention results in re-orientation of fibers from the cross-direction towards the machine direction.

Staple webs prepared by conventional air-laying methods can also be used. In an air-laying process, the blend of staple fibers is discharged into an air stream and guided by the current of air to a foraminous surface on which the fibers settle. Although the fibers in air-laid webs are significantly more randomized than in carded webs, there is generally somewhat higher fiber orientation in the machine direction. Air-laid webs which have not been re-oriented according to the process of the current invention generally have a ratio of MD to XD orientation of between about 1.5:1 and 2.5:1. Staple webs can be lightly pre-consolidated to improve the web cohesiveness and ease of handling, such as by very light mechanical needling or by passing the fabric through a nip formed by two smooth rolls or two intermeshing rolls. However, the degree of pre-consolidating should be low enough that the nonwoven web remains substantially non-bonded.

Activation of the latent spiral crimp of the multiple-component fibers is achieved by heat treatment of the web under free shrinkage conditions to a temperature sufficient to achieve spiral-crimp development that causes re-orientation of the fibers. Heat can be provided in the form of radiant heat, atmospheric steam, or hot air. The heat treatment step can be conducted in-line or the staple web can be wound up and heat-treated in subsequent processing of the web. Carded, non-cross-lapped, staple webs treated according to the process of the current invention generally have a ratio of MD to XD orientation of about 2:1 compared to starting webs having a ratio of MD to XD orientation between about 10:1 and 4:1. Air-laid webs treated according to the current invention generally have a ratio of MD to XD orientation of close to about 1:1, compared to starting air-laid webs having a ratio of MD to XD orientation between about 1.5:1 and 2.5:1.

Continuous filament webs containing spirally-crimpable filaments co-spun with non-spirally-crimpable filaments can also be used in the current invention. The continuous filament webs can be prepared using spunbond processes known in the art. Continuous filament webs can also be prepared by laydown of pre-formed filaments. For example, Davies describes a process wherein continuous monofilaments are drawn off a number of bobbins and then forwarded between two feed rolls having fluted surfaces onto a wire mesh conveyer. The rate of deposition of the filaments onto the conveyor belt is faster than the surface speed of the belt so that the filaments form a web as they are laid down on the belt. The process of Davies can be modified by drawing multiple-component filaments having latent spiral crimp from some of the bobbins and non-spirally-crimpable filaments from the remainder of the bobbins such that the multiple-component filaments having latent spiral crimp comprise about 5 to 40 weight percent of the web. In a spunbond process, some of the spin packs can be designed to form single component filaments or other non-spirally-crimpable multiple-component filaments while the remaining spin packs are designed to form spirally-crimpable multiple-component filaments. Multiple-component filaments are generally prepared by feeding two or more polymer components as molten streams from separate extruders to a spin pack which includes a spinneret comprising one or more rows of multiple-component extrusion orifices. The spinneret orifice and spin pack designs are chosen so as to provide filaments having the desired cross-section and denier per filament. The continuous filament web preferably comprises about 5 to 25 weight percent, more preferably about 10 to 20 weight percent of multiple-component filaments capable of developing three-dimensional spiral crimp. The spunbond multiple-component continuous filaments preferably have an initial helical crimp level characterized by a Crimp Index (CI) no greater than about 60%. The spirally crimped fibers (whether staple or continuous) are characterized by a Crimp Development (CD) value, wherein the quantity (% CD−% CI) is greater than or equal to 15% and more preferably greater than or equal to 25%. Preferably, the filaments have a denier per filament (dpf) between about 0.5 and 10.0. When the multiple-component filaments in the web are bicomponent filaments, the ratio of the two polymeric components in each filament is generally between about 10:90 and 90:10 based on volume (for example measured as a ratio of metering pump speeds), more preferably between about 30:70 and 70:30 and most preferably between about 40:60 and 60:40.

In conventional spunbond processes, the filaments exit the spinneret as a downwardly moving curtain of filaments and pass through a quench zone where the filaments are cooled, for example by a cross-flow air quench supplied by a blower on one or both sides of the curtain of filaments. The extrusion orifices in alternating rows in the spinneret can be staggered with respect to each other in order to avoid "shadowing" in the quench zone, where a filament in one row blocks a filament in an adjacent row from the quench air. The length of the quench zone is selected so that the filaments are cooled to a temperature such that the filaments do not stick to each other upon exiting the quench zone. It is generally not required that the filaments be completely solidified at the exit of the quench zone. The quenched filaments generally pass through a fiber draw unit or aspirator that is positioned below the spinneret. Such fiber draw units or aspirators are well known in the art and generally include an elongate vertical passage through which the filaments are drawn by aspirating air entering from the sides of the passage and flowing downwardly through the passage. The aspirating air provides the draw tension which causes the filaments to be drawn near the face of the spinneret plate and also serves to convey the quenched filaments and deposit them on a foraminous forming surface positioned below the fiber draw unit.

Alternately, the fibers may be mechanically drawn using driven draw rolls interposed between the quench zone and the aspirating jet. In that case, the draw tension which causes the filaments to be drawn close to the spinneret face is provided by the draw rolls, which also further draw the filaments between the draw rolls, and the aspirating jet serves as a forwarding jet to deposit the filaments on the web forming surface below. A vacuum may be positioned below the forming surface to remove the aspirating air and draw the filaments against the forming surface. The process conditions are chosen such that the spirally-crimpable filaments do not develop significant spiral crimp during the spinning process, such as by reducing the temperature that the fibers are exposed to after the draw tension is relaxed. Filaments in spunbond webs are generally laid down in a random pattern. However, the orientation in the machine direction is usually somewhat higher than that in the cross direction, with the ratio of MD to XD orientation typically about 1.5:1 prior to activation of the crimp development. Spunbond webs comprising blends of filaments having latent spiral crimp and non-spirally-crimpable filaments which have been treated to reorient the filaments according to the process of the current invention generally have a ratio of MD to XD orientation close to 1:1.

In conventional spunbond processes, the spunbond web is generally bonded in-line after the web has been formed and prior to winding the web up on a roll, for example by passing the non-bonded web through the nip of a heated calender. However, in the current invention, the spunbond web is left in a substantially non-bonded state and remains substantially non-bonded during heat treatment to activate the three-dimensional spiral crimp of the multiple-component fibers. Preconsolidation is not generally needed since the non-bonded spunbond webs generally have sufficient cohesiveness to be handled in subsequent processing. If desired, the web can be pre-consolidated, such as by cold calendering prior to heat treatment. As with staple webs, any pre-consolidating should be at low levels so that the continuous filament web remains substantially non-bonded. The heat treatment to activate the latent spiral crimp of the multiple-component fibers can be conducted in-line or the substantially non-bonded web can be rolled up and heat treated in later processing.

Non-spirally-crimpable staple webs can be reoriented using the process of the current invention by placing tensioned or partially relaxed longitudinally-oriented arrays of spirally-crimpable multiple-component filaments under the card webs emanating from the card doffers onto collection belts, or between layers of card webs deposited on a collection belt. When the composite is allowed to free-shrink according to the process of the current invention, such as by one of the processes shown in FIGS. 1, 2, or 3, the multiple-component filaments develop spiral crimp that engages the non-spirally-crimpable staple fibers and compresses the web in the longitudinal direction, causing reorientation of the staple fibers towards the cross-direction. This occurs provided that the non-spirally-crimpable web is about 4 oz/yd$^2$ (136 g/m$^2$) or less in basis weight. In order to re-orient heavier basis weight (i.e., greater than 4 oz/yd$^2$) webs it may be beneficial to pre-consolidate the combined spirally-crimpable filament array and non-spirally-crimpable web with moderate compression, slight mechanical needling, etc. prior to free-shrinking. It may also be beneficial for the multiple-component filaments in the array to have partially developed spiral crimp prior to combining with the staple web.

The latent spiral crimp of the multiple-component fibers is activated by heating the substantially non-bonded web under "free shrinkage" conditions. During the crimp activation step, the dimensions of the web generally shrink, with the highest shrinkage occurring in the direction of highest initial overall orientation of the fibers. The degree of web shrinkage varies depending on the initial fiber orientation and weight percent of multiple-component fibers having latent spiral crimp in the nonwoven web. Preferably, the web shrinks in length in the direction of highest initial orientation by at least about 10%, more preferably by at least about 15%, and most preferably between about 15% and 40%. The term "direction of highest initial orientation" as used herein refers to either the machine direction or the cross-direction and is determined by measuring the tensile strength in both the machine direction and the cross direction for the starting web that has been bonded, but not heat treated. The direction of highest initial orientation is that (MD or XD) for which the highest tensile strength is measured. The direction of highest orientation for non-cross-lapped carded webs, air-laid webs, and spunbond webs is generally the machine direction. The direction of highest initial orientation for cross-lapped staple webs is generally the cross-direction. It should be understood that typically within a fabric, the direction of lowest initial orientation would be substantially perpendicular to the direction of highest initial orientation.

By "free shrinkage" conditions, it is meant that there is no substantial contact between the web and surfaces that would restrict the spiral crimp development and the corresponding re-orientation of the fibers and shrinkage of the web. That is, there are substantially no mechanical forces acting on the web to interfere with or retard the crimping of the multiple-component fibers and the re-orientation of the non-spirally-crimpable fibers. In the process of the current invention, the fabric preferably does not contact any surface during the crimp activation step. Alternately, any surface that is in contact with the nonwoven web during the heat treatment step is moving at substantially the same surface speed as that of the continuously shrinking nonwoven web in contact with the surface so as to minimize frictional forces which would otherwise interfere with the nonwoven web shrinkage. "Free shrinkage" also specifically excludes processes in which the nonwoven is allowed to shrink by heating in a liquid medium since the liquid will impregnate the fabric and interfere with the motion and shrinkage of the fibers. The crimp activation step of the process of the current invention can be conducted in atmospheric steam or other heated gaseous mediums.

FIG. 1 shows a schematic side view of an apparatus suitable for carrying out the crimp-activation step in a first embodiment of the process of the current invention. Substantially non-bonded nonwoven web 10 comprising a blend of multiple-component fibers having latent spiral crimp with fibers which do not possess latent spiral crimp is conveyed to transfer zone A on a first belt 11, moving at a first surface speed. In transfer zone A, the web is allowed to fall freely until it contacts the surface of a second belt 12, moving at a second surface speed. The surface speed of the second belt is less than the surface speed of the first belt. As the substantially non-bonded web leaves the surface of belt 11, it is exposed to heat from heater 13 as it free-falls through the transfer zone. Heater 13 can be a blower for providing hot air, an infrared heat source, or other heat sources known in the art such as microwave heating or atmospheric steam. The substantially non-bonded web is heated in transfer zone A to a temperature which is sufficiently high to activate the latent spiral crimp of the multiple-component fibers and cause the web to shrink, while being free of any external interfering forces. The temperature of the web in the transfer zone and the distance the web free-falls in the transfer zone prior to contacting belt 12 are selected such that the desired crimp development is essentially complete by the time the heat-treated web contacts belt 12. The temperature in the transfer zone should be selected such that the web remains substantially non-bonded during heat treatment. When the web initially leaves belt 11, it is travelling at substantially the same speed as the surface speed of the belt. As a result of the web shrinkage resulting from the activation the latent spiral crimp of the multiple-component fibers by the heat applied in the transfer zone, the surface speed of the web may decrease as it travels through transfer zone A. The surface speed of belt 12 is selected to match as closely as possible the surface speed of the web when it leaves transfer zone A and contacts belt 12. The heat-treated web 16 may be thermally point bonded by passing through a heated calender comprising two rolls (not shown), one of which is patterned with the desired point bonding pattern. The bonding rolls are preferably driven at a surface speed that is slightly less than the speed of belt 12 to avoid drawing the web. Other types of bonding units known in the art can be used instead of the bonding rolls. Alternately, the heat-treated substantially non-bonded nonwoven web can be wound up without bonding and bonded during subsequent processing of the web.

Figure 2:
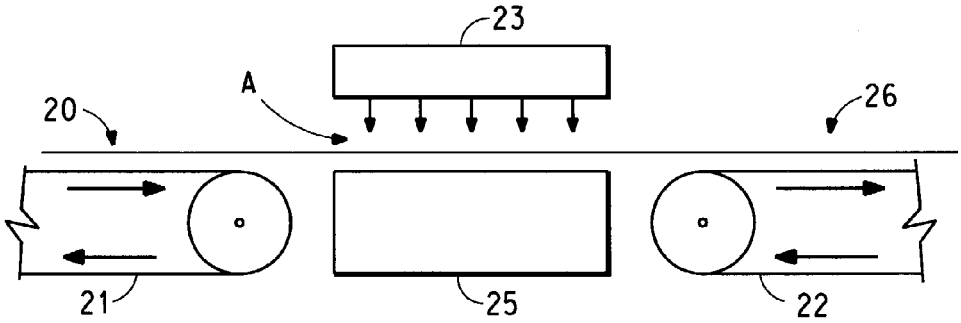
FIG. 2 is a schematic diagram of a side view of an apparatus suitable for carrying out the crimp-activation step in a second embodiment of the process of the current invention in which the web is floated on a gaseous layer in a transfer zone between two conveying belts.

FIG. 2 shows an apparatus for use in the crimp activation step of a second embodiment of the current invention. Substantially non-bonded nonwoven web 20 comprising a blend of multiple-component fibers having latent spiral crimp with fibers which do not have latent spiral crimp is conveyed on a first belt 21 which has a first surface speed to transfer zone A where it is floated on a gas and then transferred to a second belt 22 which has a second surface speed. The second surface speed is less than the first surface speed. The gas, such as air or steam, is provided through openings in the upper surface of a supply box 25 to float the web as it is conveyed through the transfer zone. The air provided to float the web may be at room temperature (approximately 25° C.) or pre-heated to contribute to the crimp development and web shrinkage. Preferably, the air or steam emanates from small densely spaced openings in the upper surface of the air or vapor supply box to avoid disturbing the web. The web can also be floated on the air flow generated by small vanes attached to rollers placed under the web. The floating web is heated in transfer zone A by radiant heater 23 (or other suitable heat source) to a temperature that is sufficient to activate the latent spiral crimp of the multiple-component fibers, causing the web to shrink while remaining substantially non-bonded. The temperature of the web in the transfer zone and the distance the web travels in the transfer zone are selected such that the desired crimp development and web shrinkage are essentially complete prior to contacting second belt 22. The surface speed of the second belt is selected to match as closely as possible the surface speed of the heat-treated web 26 as it exits transfer zone A. This set-up can be used to shrink the web in the XD or in the XD and MD simultaneously.

Figure 3:
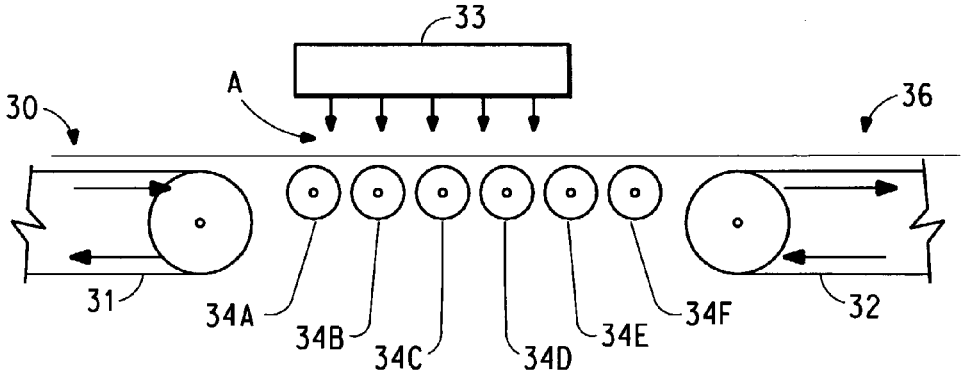
FIG. 3 is a schematic diagram of a side view of an apparatus suitable for carrying out the crimp-activation step in a third embodiment of the process of the current invention in which the web is supported during heating on a series of driven rotating rolls.

FIG. 3 shows an apparatus for use in the heat shrinkage step of a third embodiment of the current invention. Substantially nonbonded nonwoven web 30 comprising a blend of multiple-component fibers having latent spiral crimp with fibers which do not have latent spiral crimp is conveyed on a first belt 31 having a first surface speed to transfer zone A that comprises a series of driven rolls 34A through 34F. The web is conveyed through transfer zone A to belt 32 moving at a second surface speed that is lower than the first surface speed of belt 31. Although six rolls are shown on the figure, at least two rolls are required. However, the number of rolls can vary depending on the operating conditions and the particular polymers used in the multiple-component fibers. The substantially non-bonded nonwoven web is heated in transfer zone A by heater 33 to a temperature that is sufficient to activate the spiral crimp of the multiple-component fibers, causing the web to shrink while remaining substantially non-bonded. The temperature of the web in the transfer zone and the distance the web travels in the transfer zone are selected such that the desired web shrinkage and crimp development are essentially complete prior to contacting second belt 32. As the web shrinks, the surface speed of the web decreases as it is conveyed through the transfer zone. Rolls 34A through 34F are driven at progressively slower peripheral linear speeds in the direction moving from belt 31 and belt 32, with the surface speeds of the individual rolls being selected such that the peripheral linear speed of each roll is within 2–3% of the surface speed of the web as it contacts the roll. Since the rate at which the web shrinks is generally not known and is dependent upon the web construction, polymers used, process conditions, etc., the speeds of the individual rolls 34A through 34F can be determined by adjusting the speed of each roll during the process to maximize the web shrinkage and minimize non-uniformities in the web. The surface speed of the second belt 32 is selected to match as closely as possible the speed of the heat-treated web 36 as it exits transfer zone A and contacts the belt.

The process shown in FIG. 3 is useful for nonwoven webs having a direction of highest initial orientation either in the machine direction or in the cross machine direction.

The heating time for the crimp-activation step is preferably less than about 15 seconds and more preferably less than two seconds. Heating for longer periods requires costly equipment. The web is preferably heated for a time sufficient for the multiple-component fibers to develop at least 90% of their full latent spiral crimp. The temperature for activating the spiral crimp is preferably no higher than 20° C. below the onset of the melting transition temperature of the polymers as determined by Differential Scanning Calorimetry. This is to avoid undesired premature interfiber bonding. After the crimp has been activated, the web has generally shrunk in area by at least about 10 to 75% percent, preferably by at least 25 percent, and more preferably at least 40%.

The web can be heated using any of a number of heating sources including microwave radiation, hot air, steam, and radiant heaters. The web is heated to a temperature sufficient to activate the spiral crimp, but which is still below the softening temperature of the lowest melting polymeric component such that the web remains substantially non-bonded during crimp development.

After the non-bonded nonwoven web is heat treated to activate the three-dimensional spiral crimp and re-orient the non-spirally-crimpable fibers, the web may be bonded using methods known in the art. The bonding may be conducted in-line following the heating step or the substantially nonbonded heat-treated nonwoven fabric can be collected, such as by winding on a roll, and bonded in subsequent processing.

The bonding method is chosen based on the nature of the web and the desired end use and fabric properties. For example, the heat-treated web can be bonded by hot-roll calendering, thermal point bonding, through-air bonding, mechanical needling, hydraulic needling, chemical bonding, powder bonding, liquid-spray adhesive bonding, impregnating the web with a suitable flexible liquid binder, or by passing the web through a saturated-steam chamber at an elevated pressure. In thermal point bonding, the fabric is bonded at a plurality of thermal bond points located across the spunbond fabric such as by passing the fabric through an ultrasonic bonder or between heated bonding rolls in which one of the rolls includes a raised pattern of protuberances corresponding to the desired point bonding pattern. The bonding may be in continuous or discontinuous patterns, uniform or random points or a combination thereof. Preferably, the point bonds are spaced at about 5 to 40 per inch (2 to 16 per centimeter) with approximately 25–400 bonds/in$^2$ (3.9 to 62 bonds/cm$^2$). The bond points can be round, square, rectangular, triangular or other geometric shapes, and the percent bonded area can vary between about 5 and 50% of the surface of the nonwoven fabric. Liquid binder, for example latex, can be applied, such as by printing in a pattern or spraying onto the nonwoven web. The liquid binder is preferably applied to the nonwoven such that it forms bonds that extend through the entire thickness of the web. Alternately, binder fibers or binder particles can be dispersed into the web and the web bonded using smooth heated calender rollers. Preferably, the binder particles or fibers have dimensions of at least 0.2 mm to about 2 mm in at least one direction and are added to the web at levels to provide between about 20 and 400 bonds/in$^2$ (3 to 62 bonds/cm$^2$). The low-melting binder particles typically amount to about 5 to 25% of the product weight. When using binder fibers or particles, it is important that the temperature required to activate and bond the low-melting binder is greater than the temperature used to activate the crimp of the spirally-crimpable fibers so that the web remains substantially non-bonded during the crimp activation step.

Test Methods

In the description above and in the examples that follow, the following test methods were employed to determine various reported characteristics and properties.

Tensile Strength Measurement

Tensile strength was measured using an Instron Tensile Tester. For each sample, a series of 2.5 inches (6.4 cm) by 6 inches (15.2 cm) rectangular strips were cut, one group with the 6 inches (15.2 cm) length in the MD and one group with the 6 inches (15.2 cm) length in the XD. The weight in grams of each sample was determined and it was then mounted in the Instron with a 4 inch (10.2 cm) gage length. The load was applied with a crosshead speed of 2.00 in/min (5.08 cm/min) until the sample ruptured. The grams of force and maximum extension at rupture were recorded for each sample. The entire analysis was done under the controlled conditions of 70° F. (21° C.) ambient temperature and 52% relative humidity. The MD/XD ratio is calculated by taking the force at rupture in the MD and dividing by the XD force at rupture.

The improvement in MD/XD ratio for examples of the invention relative to the comparative (control) examples are defined by the following.

% Reduction=100*[Ratio(control)−Ratio(invention)]/Ratio(control)]

Crimp Level Measurement

Crimp properties for the multiple-component fibers used in the examples were determined according to the method disclosed in Evans. This method comprises making 4 length measurements on a wrapped bundle of the multiple-component fiber in filament form (this bundle is referred to as a skein). These 4 length measurements are then used to calculate 4 parameters that fully describe the crimp behavior of the multiple-component fiber.

The analytical procedure consists of the following steps:

1.) Prepare a skein of 1500 denier from a package of the multiple-component fiber. Since a skein is a circular bundle, the total denier will be 3000 when analyzed as a loop.

2.) The skein is hung at one end, and a 300 gm weight is applied at the other. The skein is exercised by moving gently up and down 4 times and the initial length of the skein (Lo) is measured.

3.) The 300 gm weight is replaced with a 4.5 gm weight and the skein is immersed in boiling water for 15 minutes.

4.) The 4.5 gm weight is then removed and the skein is allowed to air dry. The skein is again hung and the 4.5 gm weight is replaced. After exercising 4 times, the length of the skein is again measured as the quantity Lc.

5.) The 4.5 gm weight is replaced with the 300 gm weight and again exercised 4 times. The length of the skein is measured as the quantity Le.

From the quantities Lo, Lc and Le, the following quantities are calculated:

CD=Crimp development=100*(Le−Lc)/Le

SS=Skein Shrinkage=100*(Lo−Le)/Lo

CI=Crimp Index and is calculated identical to CD with step 3 omitted in the above procedure.

Web Shrinkage Determination

This property is measured in the machine direction or cross-direction by obtaining a 10-inch (25.4-cm) long section of web with the length of the sample being measured in the machine direction or cross-direction, respectively. The sample is then heated to 80° C. for 20 seconds under relaxed conditions (i.e., in a manner such that free shrinkage may occur, such as that depicted in FIG. 1). After heating, the web is allowed to cool to room temperature and the length of the sample is measured. The % shrinkage is calculated as 100*(10 inches−Measured length)/10 inches.

Basis Weight Determination

A sample is cut to the dimensions 6.75 inches by 6.75 inches and weighed. The mass in grams obtained is equal to the basis weight in oz/yd$^2$. This number may then be multiplied by 33.91 to convert to g/m$^2$.

Intrinsic Viscosity Determination

The intrinsic viscosity (IV) was determined using viscosity measured with a Viscotek Forced Flow Viscometer Y900

(Viscotek Corporation, Houston, Tex.) for the polyester dissolved in 50/50 weight % trifluoroacetic acid/methylene chloride at a 0.4 grams/dL concentration at 19° C. following an automated method based on ASTM D 5225-92.

EXAMPLES 1–2

Side by side bicomponent filament yarn was prepared by conventional melt spinning of polyethylene terepthalate (2GT) having an intrinsic viscosity of 0.52 dl/g and polytrimethylene terepthalate (3GT) having an inherent viscosity of 1.00 dl/g through round 34 hole spinnerets with a spin block temperature of 255° C.–265° C. The polymer volume ratio in the fiber was controlled to 60/40 2GT/3GT by adjustment of the polymer throughput during melt spinning. The filaments were withdrawn from the spinneret at 450–550 m/min and quenched via conventional cross-flow air. The quenched filament bundle was then drawn to 4.4 times its spun length to form yarn of continuous filaments having a denier per filament (dpf) of 2.2, which were annealed at 170° C., and wound up at 2100–2400 m/min. For conversion to staple fiber, the yarn was collected into a tow and fed into a conventional staple tow cutter to obtain staple fiber having a cut length of 2.75 inches (6.985 cm). The crimp properties of this fiber were CI=13.92% and CD=45.25%.

Carded webs were prepared from a blend of 80 wt % poly(ethylene terephthalate) staple fiber and 20 wt % of the 2GT/3GT bicomponent fibers described above. The poly (ethylene terepthalate) fiber used was a commercial Dacron product T-54W. This fiber is characterized as a 1.5 denier per filament (dpf) PET staple fiber cut to 1.5 inches (3.81 cm) and has mechanical crimp imparted by standard stuffer box crimping methods. The blended fibers were carded on a standard, staple, textile card line. For the samples of the invention, the carded webs were then passed from one conveyor belt to another one separated by a height of 15 inches (38.1 cm). During the time in which the web was falling freely from one belt to another, radiant heat sufficient to heat the web to 60° C. was applied to the web to uniformly develop the spiral crimp of the multiple-component fibers. The measured cross directional web shrinkage was 32% for the web containing multiple-component fibers in Example 1 and 28% for the web containing multiple-component fibers in Example 2. The webs were then thermally point bonded using a patterned calender bonder heated to 214° C. on the top patterned roll and 205° C. on the bottom smooth roll. These conditions were chosen to provide well-bonded materials as judged by the formation of well-defined bond points without the generation of harshness in the fabrics due to excessive surface melting. The fabrics were bonded using a diamond pattern with a 26% bond area. Staple card speeds and the speed at which the webs were fed into the calender was kept constant at 15 meters/minute.

Table 1 below summarizes the basis weights and MD/XD ratios for the webs. The results in Table 1 demonstrate that the carded bonded webs of Examples 1 and 2 which comprise a blend of spirally-crimpable fibers with non-spirally-crimpable fibers are more randomly oriented and have a better balance of MD and XD properties than comparative examples A, B, and C. Comparative example A demonstrates the effect of omitting the preheat treatment step on the MD/XD property balance, while Comparative example B demonstrates a typical MD/XD ratio obtained with the prior art. The improvements obtained scale for differing basis weights, with greater improvement being realized for lower basis weight fabrics.

TABLE 1

| Example | Item Description | Basis wt. oz/yd$^2$ | MD/XD Ratio |
|---|---|---|---|
| 1 | 80% PET T-54W/20% 2GT/3GT | 0.84 | 2.76 |
| A | Example 1, without preheating | 0.79 | 4.14 |
| B | 100% PET (T-54W) | 0.72 | 10.91 |
| 2 | 80% PET T-54W/20% 2GT/3GT | 1.98 | 2.05 |
| C | 100% PET (T-54W) | 1.51 | 5.43 |

As shown in Table 1, Example 1 demonstrates a 74.7% reduction in the MD/XD ratio relative to Comparative Example B. Example 2 shows a 62.2% reduction in MD/XD ratio relative to Comparative Example C. The balance of fiber orientation for heat-treated web of Example 1 is improved by 33% relative to the starting (no heat-treatment) web.

EXAMPLE 3

This example demonstrates the ability of multiple-component fibers to impart improved MD/XD directionality for bonded materials prepared from microfiber PET materials. In this example, samples were prepared as described for Examples 1–2, with the exceptions that the multiple-component fiber was 4.4 dpf cut to 1.5inches (3.8 cm) with crimp properties CI=11.68% and CD=43.96%. Also the non-spirally-crimpable fiber used was a commercial Dacron staple fiber T-90S (mechanically crimped, cut length 1.45 inches (3.7 cm), 0.9 dpf).

TABLE 2

| Example | Item Description | Basis wt. oz/yd$^2$ | MD/XD Ratio |
|---|---|---|---|
| 3 | 80% PET T-90S/20% 2GT/3GT | 0.59 | 4.86 |
| D | 100% PET (T-90S) | 0.53 | 36.80 |

As shown in the table, Example 3 demonstrates a 86.7% reduction in the MD/XD ratio.

EXAMPLE 4

This example demonstrates the ability of the multiple-component fibers to impart improved MD/XD directionality for web materials bonded through hydraulic entanglement. Carded webs were prepared and preshrunk as described in examples 1 and 2. In this example the webs were hydraulically entangled at 60 yards/minute through a series of pressurized water jets with the following design. Jet 1 was designated, 5/40, meaning a row of 5 mil (0.127 mm) (1 mil=0.001 inch) diameter holes with a density of 40 per inch (15.7 per cm). The web was placed behind 75 mesh screen and then passed into the jet path under a series of successively increasing water pressures. The pressure series contained single passes at 300, 800, and 1500 psi. After this sequence, the web was turned over and placed behind a 24 mesh screen and the sample was again subjected to successive single passes through the water jets as the pressure was increased from 300, 1000, 1500, and 1800 psi. At the last pressure (1800 psi) the sample was processed a total of 7 times through the jet zone.

TABLE 3

| Example | Item Description | Basis wt. oz/yd$^2$ | MD/XD Ratio |
|---|---|---|---|
| 4 | 80% PET T-90S/20% 2GT/3GT | 1.69 | 1.52 |
| E | 100% PET (T-90S) | 1.24 | 3.72 |

As shown in the table, Example 4 demonstrates a 59.1% reduction in the MD/XD ratio.

EXAMPLE 5

In this example the samples were prepared and treated identically to example 4 with the exception that prior to the hydroentangling process, a 1.0 oz/yd$^2$ (33.9 g/m$^2$) layer of wood pulp based paper was placed on top of the web samples. In this example, the paper layer and the web material were entangled together by the hydraulic entanglement process.

TABLE 4

| Example | Item Description | Basis wt. oz/yd$^2$ | MD/XD Ratio |
|---|---|---|---|
| 5 | 80% PET T-90S/20% 2GT/3GT | 2.75 | 1.08 |
| F | 100% PET (T-90S) | 2.21 | 2.34 |

As shown in the table, Example 5 demonstrates a 53.8% reduction in the MD/XD ratio.

What is claimed is:

1. A method for modifying the ratio of machine-direction and cross-direction orientation in nonwoven webs which comprises the steps of:

providing a substantially non-bonded nonwoven web having an initial direction of highest fiber orientation, the web comprising about 5 to 40 weight percent of a first fiber component and about 95 to 60 weight percent of a second fiber component, the first fiber component consisting essentially of multiple-component fibers capable of developing three-dimensional spiral crimp upon heating and the second fiber component consisting essentially of fibers which do not develop spiral crimp upon heating; and heating the substantially non-bonded nonwoven web under free shrinkage conditions to a temperature sufficient to cause the multiple-component fibers to develop three-dimensional spiral crimp, the heating temperature being selected such that the heat-treated nonwoven web remains substantially non-bonded during the heating step and to cause the substantially non-bonded nonwoven web to shrink by at least about 10% in the initial direction of highest original web orientation, wherein the nonwoven' web further has a surface speed and wherein the free-shrinkage heating step comprises the steps of:

conveying the substantially non-bonded nonwoven web on a first conveying surface having a first conveying surface speed;

transferring the substantially non-bonded nonwoven web from the first conveying surface through a transfer zone to a second conveying surface, the second conveying surface having a second conveying surface speed; the substantially non-bonded nonwoven web being conveyed through the transfer zone free of contact with the conveying surfaces;

conducting the heat treatment in the transfer zone, causing the web surface speed to decrease as the web is conveyed through the transfer zone a result of crimp development of the multiple-component fibers; and transferring the heat-treated substantially non-bonded nonwoven web to the second conveying surface as the web exits the transfer zone, the second conveying surface speed being less than the first conveying surface speed.

2. The method according to claim 1 wherein the substantially non-bonded nonwoven web has a machine-direction and a cross-direction, the initial direction of highest fiber orientation being the machine direction, and wherein the ratio of machine-direction and cross-direction fiber orientation after heating the web is at least 30% less than the ratio of machine-direction and cross-direction of a web consisting of 100% of the non-spirally-crimpable fibers as measured by the ratio of machine-direction to cross-direction tensile strength after bonding the webs.

3. The method according to either of claim 1 or 2 wherein the first fiber component consists essentially of bicomponent fibers of poly(ethylene terephthalate) and poly(trimethylene terephthalate).

4. The method according to either of claim 1 or 2 wherein the first fiber component and the second fiber component are independently selected from the group consisting of staple fibers and continuous filaments.

5. The method according to claim 4 wherein the first fiber component and the second fiber component both comprise staple fibers.

6. The method according to claim 5 wherein the first fiber component comprises staple fibers having a length between about 2 and 3 inches (5 and 7.6 cm) and the second fiber component comprises staple fibers having a length of between about 0.5 and 1.5 indies (1.3 to 3.8 cm).

7. The method according to claim 4 wherein the first fiber component and the second fiber component both comprise continuous filaments.

8. The method according to claim 4 wherein the first fiber component comprises continuous filaments and the second fiber component comprises staple fibers.

9. The method according to claim 8 wherein the first fiber component comprises an array of continuous filaments oriented substantially in the machine direction.

10. The method according to claim 5 wherein the substantially non-bonded nonwoven web is a carded web.

11. The method according to claim 5 wherein the web is an air-laid web.

12. The method according to claim 5 wherein the substantially non-bonded web comprises about 10 to 25 weight percent of the first fiber component and about 75 to 90 weight percent of the second fiber component.

13. The method according to claim 7 wherein the substantially non-bonded web comprises about 10 to 20 weight percent of the first fiber component and about 80 to 90 weight percent of the second fiber component.

14. The method according to claim 1 wherein the second conveying surface speed is selected to be approximately equal to the surface speed of the heat-treated substantially non-bonded nonwoven web as the web contacts the second conveying surface upon exiting the transfer zone.

15. The method according to claim 1 wherein the substantially nonbonded nonwoven web is conveyed though the transfer zone by allowing the web to free fall through the transfer zone.

16. The method according to claim 1 wherein the substantially nonbonded nonwoven web is conveyed through the transfer zone by floating the web by blowing a gas from below the web.

17. The method according to claim 1 further comprising the step of bonding the heat-treated web after it has exited the transfer zone.

18. The method of claim 1, wherein during the heating step the substantially non-bonded nonwoven web is caused to shrink by at least about 15% in the initial direction of highest original web orientation.

19. The method of claim 18, wherein during the heating step, the substantially non-bonded nonwoven web is caused to shrink by at least about 15% to 40% in the initial direction of highest original web orientation.

20. A method for modifying the ratio of machine-direction and cross-direction orientation in nonwoven webs which comprises the steps of;

providing a substantially non-bonded nonwoven web having an initial direction of highest fiber orientation, the web comprising about 5 to 40 weight percent of a first fiber component and about 95 to 60 weight percent of a second fiber component, the first fiber component consisting essentially of multiple-component fibers capable of developing three-dimensional spiral crimp upon heating and the second fiber component consisting essentially of fibers which do not develop spiral crimp upon heating; and heating the substantially non-bonded nonwoven web under free shrinkage conditions to a temperature sufficient to cause the multiple-component fibers to develop three-dimensional spiral crimp, the heating temperature being selected such that the heat-treated nonwoven web remains substantially non-bonded during the heating step and to cause the substantially non-bonded nonwoven web to shrink by at least about 10% in the initial direction of highest original web orientation, wherein the free-shrinkage heating step comprises the steps of:

conveying the substantially nonbonded nonwoven web on a first conveying surface having a first conveying surface speed;

transferring the substantially nonbonded nonwoven web through a transfer zone to a second conveying surface, the second conveying surface having a second conveying surface speed and the substantially nonbonded nonwoven web having a nonwoven surface speed which decreases as the substantially nonbonded nonwoven is conveyed through the transfer zone;

conveying the substantially nonbonded nonwoven web through the transfer zone on a series of at least two driven rolls, each of the driven rolls having a peripheral linear speed, the peripheral linear speed of the rolls progressively decreasing as the web moves through the transfer zone;

conducting the heat treatment in the transfer zone, causing the web surface speed to decrease as the web is conveyed through the transfer zone as a result of crimp development of the multiple-component fibers; and transferring the heat-treated substantially nonbonded nonwoven web to the second conveying surface as the web exits the transfer zone, the second conveying surface speed being less than the first conveying surface speed.

21. The method according to claim 20 wherein the peripheral linear speed of each roll is approximately equal to the nonwoven surface speed as it contacts each roll and the second conveying surface speed is selected to be approximately equal to the surface speed of the heat-treated substantially nonbonded nonwoven web as the web contacts the second conveying surface upon exiting the transfer zone.

22. The method according to claim 20 wherein the peripheral linear speed of adjacent rolls varies by less than 20%.

23. The method according to claim 22 wherein the peripheral linear speed of adjacent rolls varies by less than 10%.

24. The method according to claim 23 further comprising the step of bonding the heat-treated web after it has exited the transfer zone.

25. The method according to either of claim 17 or 24, wherein the bonding step is selected from one of the group consisting of hot-roll calendering, thermal point bonding, through-air bonding, mechanical needling, hydraulic needling, chemical bonding, powder bonding, liquid-spray adhesive bonding, impregnating with a flexible liquid binder, and passing through a saturated-steam chamber at an elevated pressure.

26. The method according to claim 20 wherein the substantially nonbonded nonwoven web is a cross-lapped staple web.

* * * * *